US006843285B2

(12) United States Patent
Ozawa

(10) Patent No.: US 6,843,285 B2
(45) Date of Patent: Jan. 18, 2005

(54) CONTAINER AND PLUG FOR CONTAINER

(75) Inventor: Toshihiko Ozawa, Gyoda (JP)

(73) Assignee: Surpass Industry Co. Ltd., Gyoda (JP)

( * ) Notice: Subject to any disclaimer, the term of this patent is extended or adjusted under 35 U.S.C. 154(b) by 285 days.

(21) Appl. No.: 10/434,562

(22) Filed: May 9, 2003

(65) Prior Publication Data

US 2003/0196723 A1 Oct. 23, 2003

Related U.S. Application Data

(62) Division of application No. 09/975,595, filed on Oct. 10, 2001, now Pat. No. 6,634,396.

(30) Foreign Application Priority Data

Oct. 11, 2000 (JP) ..... P2000-311170

(51) Int. Cl.[7] ..... B65B 1/04; B65B 3/04; B67C 3/00

(52) U.S. Cl. ..... 141/326; 141/325; 141/346; 141/348; 141/383; 137/587; 137/588; 137/589; 137/590

(58) Field of Search ..... 141/285, 325, 141/326, 346–349, 374, 383, 386; 220/86.2, DIG. 32, DIG. 33; 137/583, 584, 587–590

(56) References Cited

U.S. PATENT DOCUMENTS 3,802,470 A * 4/1974 Coleman ..... 141/5
5,511,692 A * 4/1996 Willingham ..... 222/1
2002/0121313 A1 * 9/2002 Burns ..... 141/59

* cited by examiner

*Primary Examiner*—Timothy L. Maust
(74) *Attorney, Agent, or Firm*—Kolisch Hartwell PC

(57) ABSTRACT

The object of this invention is to improve safety by preventing the leakage of liquid caused by the internal pressure of a container. A liquid path plug in which a pipe is provided in the lid section of the plug, and a gas path plug which does not have a pipe are attached to openings of the container. The engaging groove section is formed on the end surface of the liquid path cap which closes the through hole provided in the liquid path plug section of the liquid path plug. The engaging protrusion section and the engaging hole section are formed on the end surface of the gas path cap which is provided in the gas path plug section of the gas path plug and closes the through hole. The gas path cap is detached by engaging the engaging pin of the detaching fixture on the engaging hole section of the gas path cap and by turning the gas path cap. The liquid path cap is detached by engaging the engaging protrusion section of the detached gas path cap on the engaging groove section of the liquid path cap and by turning the gas path cap.

10 Claims, 12 Drawing Sheets

CONTAINER AND PLUG FOR CONTAINER

CROSS-REFERENCE TO RELATED APPLICATION

This application is a divisional application of U.S. non-provisional patent application Ser. No. 09/975,595, now U.S. Pat. No. 6,634,396, entitled "Container and Plug for Container," filed on Oct. 10, 2001.

BACKGROUND OF THE INVENTION

1. Field of the Invention

The present invention relates to a container which stores liquids such as highly purified chemicals for semiconductors and ordinary chemical agents, and a plug for such a container.

2. Description of the Related Art

Generally, a semiconductor high pure chemical and an ordinary chemical agent are stored in containers which are resistable to such agents.

Formally, as shown in FIG. 16, two openings 1*a* are formed in this container 1, plugs 2 each of which has a plug section (not shown in the drawing) are positioned in these openings 1*a*. These plugs 2 function as lids which close the openings 1*a*, one is a plug 2*a* for connection to the liquid path, and the other one is a plug 2*b* for connection to the gas path, and a pipe 3 which extends to the vicinity of the bottom of the container 1 is connected to the liquid path plug 2*a* for connection to the liquid path.

Also, a cap is put on the plug sections of each plug 2 positioned in the openings la in this type of container 1, the through hole which is formed in the plug section is closed by this cap, and the liquid in this container is carried or stored in this state.

Consequently, when taking out the liquids stored in this container 1, firstly, after the caps which had been put on the plug sections of the plugs 2 which were positioned in the openings 1*a* are removed, sockets 5 connected with hoses 4 are connected to the plug sections of these plugs 2, and the liquid inside the container 1 is drawn out into the hose 4 by way of the pipe by a pump P.

Additionally, at this time, inert gas is fed into the container 1 from the hose 4 which is connected to the plug section of the plug 2*b* on the other side in such a way that the pressure inside of the container 1 is not negative. Also, it can be determined by the flow of gas on the gas drawing-side whether all the liquid inside the container 1 was fed out and whether the container 1 has become empty. Consequently, when a gas flow is detected, it is determined that the inside of the container 1 is empty, and this empty container 1 can be replaced by a new container 1 in which liquid is stored.

There are the cases in which the liquid inside the container 1 vaporizes as time goes by, so there is concern that the internal pressure increases during use. This occurs particularly when the liquid inside the container 1 is volatile.

Therefore, if the cap of the plug section of plug 2*a* for connection with the liquid path is detached when the internal pressure is high in this way, there is concern that the liquid will leak travel along the way of the pipe 3 and leak from the through hole of the plug section because of the internal pressure of the container 1.

For this reason, a sign is placed on the plug 2*a* on which the pipe 3 is provided indicating that the plug 2*a* is to be used for connection with the liquid path, and a sign is placed on the other plug 2*b* on which pipe 3 is not provided, indicating that the plug 2*b* is to be used for connection with the gas path. An operator detaches the cap put on the plug section of plug 2*a* for connection with liquid path, after identifying the signs on these plugs 2*a* and 2*b* and taking out the cap which was put on the plug section of plug 2*a* for connection with the gas path from the plug in order to lower the internal pressure of the container 1.

However, with the above container 1, the removal of the caps in turn has to be performed only according to the signs on the plugs 2*a* and 2*b*; therefore an improvement in safety is desired.

The present invention was made in light of the above situation, and an object of the present invention is to a provide a container and plugs for the container with greater safety such that liquid does not leak due to the internal pressure during use.

SUMMARY OF THE INVENTION

In order to achieve the above object, the container (1) according to a first aspect of present invention has a container body (10), at least one liquid path plug (11) and at least one gas path plug (12) which are attached to openings (10*a*) formed in the container body (10). The liquid path plug (11) has a lid section (14) attached to the opening (10*a*) in a watertight manner. A liquid path plug section (16*b*) having a through hole (16*a*) which communicates with an inner space of the container body and a pipe (17) which is connected to the liquid path plug section (16*b*). A liquid path plug section (16*b*) is provided in the container body, and a liquid path cap (22) is detachably attached to the liquid path plug section (16*b*) to block the through hole (16*a*). The gas path plug (12) has a lid section (14) attached to the opening (10*a*) in a watertight manner, and a gas path plug section (16*c*) having a through hole (16*a*) communicating with the inner space of the container body, and a gas path cap (22) which is detachably attached to the gas path plug section (16*c*) to block the through hole (16*a*). The gas path cap (22) has a disengaging section (35) which can be used to detach the liquid path cap (22) from the liquid path plug section.

In the container according to the first aspect, when drawing out the liquid inside the container by detaching the liquid path cap and the gas path cap which respectively close the through holes of the plug sections of the liquid path plug and the gas path plug fitted in the openings, because the liquid path cap is made detachable by means of the gas path cap which is detached from the plug section of the gas path plug. When detaching each cap in order to draw out the liquid inside the container, the detaching of the liquid path cap is always done after detaching the gas path cap. As a result, even if the internal pressure increases due to the vaporization of the liquid inside the container, when detaching the liquid path cap, the difference in the pressure between the inside and the outside of the container is nullified because the gas path cap of the gas path plug has already been detached. Therefore, problems such that the liquid inside the container passes along the pipe and leaks from the through hole of the plug can be securely eliminated.

More specifically, by performing above detaching steps, it is possible to quite easily detach the gas path cap and the liquid path cap from the gas path plug and the liquid path plug, connect the socket to which the hose is connected, and draw out the liquid inside the container.

In the container according to a second aspect of present invention, the gas path cap can be detached using the detaching fixture.

More specifically, when detaching the gas path cap which is put on the gas path plug section, because the detaching fixture is used, the step of opening the liquid path cap and the gas path cap is securely carried out; therefore safety can be further improved.

In the container according to a third aspect of present invention, the plug section is formed as a cylinder in which the through hole is formed in the center, the liquid path cap and the gas path cap are positioned covering the plug sections and the liquid path cap and the gas path cap are formed as cylinders having a bottom section such that the through hole of the plug section is closed.

More specifically, by putting respectively the liquid path cap which is formed as a cylinder which has a bottom section and the gas path cap on the plug section which is formed as a cylinder, it is possible to securely and easily seal the through holes of the plug sections of the container when carrying and storing.

With the container according to a third aspect, by respectively covering the plug section formed as a cylinder with the liquid path cap and the gas path cap which are cylinders with bottom sections, and by positioning the liquid path cap and the gas path cap on the plug sections, it is possible to securely and easily seal the through hole of the plug section of the container when carrying and storing.

In the container according to a fourth aspect of present invention, in a container as described in the third aspect has a male thread formed on the external surface of the plug section, a female thread which can engage the male thread of the plug section is formed on the internal surface on liquid path cap and the gas path cap, and by engaging the female thread to the male thread, the liquid path cap and the gas path cap are fitted into the plug section.

More specifically, by respectively twisting the liquid path cap side thread and gas path cap with respect to the plug sections, attachment and detachment of the liquid path cap and the gas path cap to and from the plug sections can be carried out easily.

In the container according to a fourth aspect, by turning respectively the liquid path cap and the gas path cap with respect to the plug sections, it is possible to quite easily attach the liquid path cap and the gas path cap to the plug sections and to detach the liquid path cap and the gas path cap from the plug sections.

In the container according to a fifth aspect of present invention, an engaging device which engage by means of convexo-concave interfitting is provided between the detaching fixture and the gas path cap, and between the gas path cap and the liquid path cap.

In this way, because the construction is such that the convexo-concave interfitting is provided between the detaching fixture and the gas path cap, and between the gas path cap and the liquid path cap, the operation of detaching the liquid path cap and the gas path cap can be easily performed.

In the container according to a sixth aspect of present invention, an engaging pin is provided on the detaching fixture so as to fit to an engaging hole section which is formed on the end surface of the gas path cap. An engaging protrusion section is formed on the gas path cap so as to fit to an engaging groove section formed on the end surface of the liquid path cap. An engaging device is constructed by respectively engaging the engaging pin with the engaging hole section, and the engaging hole section with the engaging groove section.

More specifically, by fitting the engaging pin of the detaching fixture into the engaging hole section of the gas path cap and by turning the engaging pin, it is possible to quite easily unscrew and detach the gas path cap using the detaching fixture, also by fitting the engaging protrusion section of the gas path cap into the engaged groove of the liquid path cap and by turning the engaging protrusion section, it is possible to quite easily unscrew and detach the liquid path cap using the gas path cap.

In the container according to a sixth aspect, by fitting the engaging pin of the detaching fixture into the engaging hole of the gas path cap and by turning the engaging pin, it is possible to unscrew the gas path cap using the detaching fixture and to detach the gas path cap quite easily, also by fitting the engaging protrusion section of the gas path cap into the engaging groove section of the liquid path cap and by turning the engaging protrusion section, it is possible to unscrew the liquid path cap using the gas path cap and detach the liquid path cap quite easily.

In the container according to a seventh aspect of present invention, a gas removal path which is closed by the cap which is fitted and communicates between the external surface and the bottom surface of the lid section is formed in the plug section of the liquid path plug, and when detaching the liquid path cap, the gas removal path is opened before the through hole.

In this way, even if in the worst case the internal pressure of the container increases when detaching the liquid path cap, when the liquid path cap is detached, the opening of the gas removal path formed in the plug section is opened and the inside of the container communicates with the outside of the container before the through hole of the plug section is opened, and problems that the liquid passes along the pipe and leaks from the through hole can be more securely avoided.

Accordingly, if an operator tries to detach the liquid path cap of the plug section of the liquid path plug of other container by using the gas path cap which is detached from the plug section of the gas path plug of the container, the leak of the liquid from the through hole of the plug section due to the internal pressure of the container can be securely prevented.

In the container according to the seventh aspect, even if the internal pressure of the container increases for whatever reason, when detaching the liquid path cap, the opening of the gas removal path formed in the plug section is opened, and the inside of the container communicates with the outside of the container before the through hole of the plug section is opened when detaching the liquid path cap, and problems such that liquid passes through the pipe and leaks from the through hole can be securely prevented.

Accordingly, even if an operator tries to detach the liquid path cap of the plug section of the liquid path plug of other container using the gas path cap detached from the plug section of the gas path plug of the container, it is possible to prevent securely the leakage of liquid from the through hole of the plug section due to the internal pressure of the container.

The plug which is used in the container described in an eighth aspect of present invention is characterized in that the lid section is attached to an opening of the container, the plug section has a through hole which is fixed to the lid section and connects the inside and the outside of the container, and a gas removal path is fixed to the lid section (14) and connects the inside and the outside of the container. A pipe connects the through hole which is provided in the plug section, a cap is fixed to the plug section, and closes the through hole and the gas removal path. The gas removal path is provided in the position such that the opening of the gas removal path is opened before the through hole is opened when detaching the cap.

More specifically, when opening the through hole of the plug section by detaching the cap, the gas removal path formed in the plug section is opened before the through hole is opened, and the inside of the container communicates with the outside of the container; therefore, the difference in the pressure is nullified even if the inside pressure of the container increases, and problems such that the liquid passes through the pipe and leaks from the through hole can be more securely avoided.

In the plug according to a ninth aspect of present invention, the plug section is formed as a cylinder in which the through hole is formed in the center, the gas removal path is opened on the external surface of the plug section, the cap is formed as a cylinder with a bottom section which covers the plug, a sealing material which seals the gap between the plug and the cap provided on the internal surface. When moving the cap which is fitted to the plug in the direction of the top of the plug in order to detach the cap, by moving the sealing material further forward the top of the plug section than the opening of the gas removal path, the gas removal path is opened before the through hole is opened.

More specifically, when moving the cap towards the top of the plug in order to detach the cap, because the sealing material provided on the internal surface of the cap moves to the farther side of the top of the plug than the opening part of the gas removal path, the gas removal path is opened before the through hole is opened, the difference in the pressure between the inside and the outside of the container is nullified, and problems such that the liquid passes through the pipe and leaks from the through hole can be more securely avoided.

In the plug according to a tenth aspect of present invention, the male thread is formed on the external surface of the plug on the plug section, the female thread which can be screwed with the male thread of the plug section is formed on the internal surface of the cap, and by screwing the male thread into the female thread, the cap is fixed to the plug section.

In this way, when detaching the cap which has been screwed into the plug section by unscrewing the cap, the sealing material provided in the internal surface of the cap moves towards the farther side of the top of the plug than the opening of the gas removal path, and the gas removal path is opened before the through hole is opened; therefore, the difference in the pressure between the inside and the outside of the container is nullified, and problems such that the liquid passes through the pipes and leaks from the through hole can be more securely avoided.

Also, by covering the plug section by the cap and by screwing the cap into the plug section, it is quite easily possible to put the cap on the plug section, close the through hole and the gas removal path, and perform the carrying the container and the storing the liquid in the container.

In the plug which is used in the container according to the tenth aspect, when unscrewing the cap which has been screwed onto the plug section and detaching the cap, the sealing material provided in the internal surface of the cap moves towards the farther side of the top of the plug section than the opening of the gas removal path, the gas removal path is opened before the through hole is opened, the difference in the pressure between the inside and the outside of the container is nullified, and problems such that the liquid passes through the pipe and leaks from the through hole can be securely prevented.

Also, by covering the plug section with the cap and by screwing the cap onto the plug section, it is possible to put the cap on the plug section, close the through hole and the gas removal path, carrying the container and store the liquid quite easily.

DETAILED DESCRIPTION OF THE INVENTION

The container and the plug for the container according to the embodiments of present invention are explained with reference to the drawings.

First Embodiment

Figure 1:
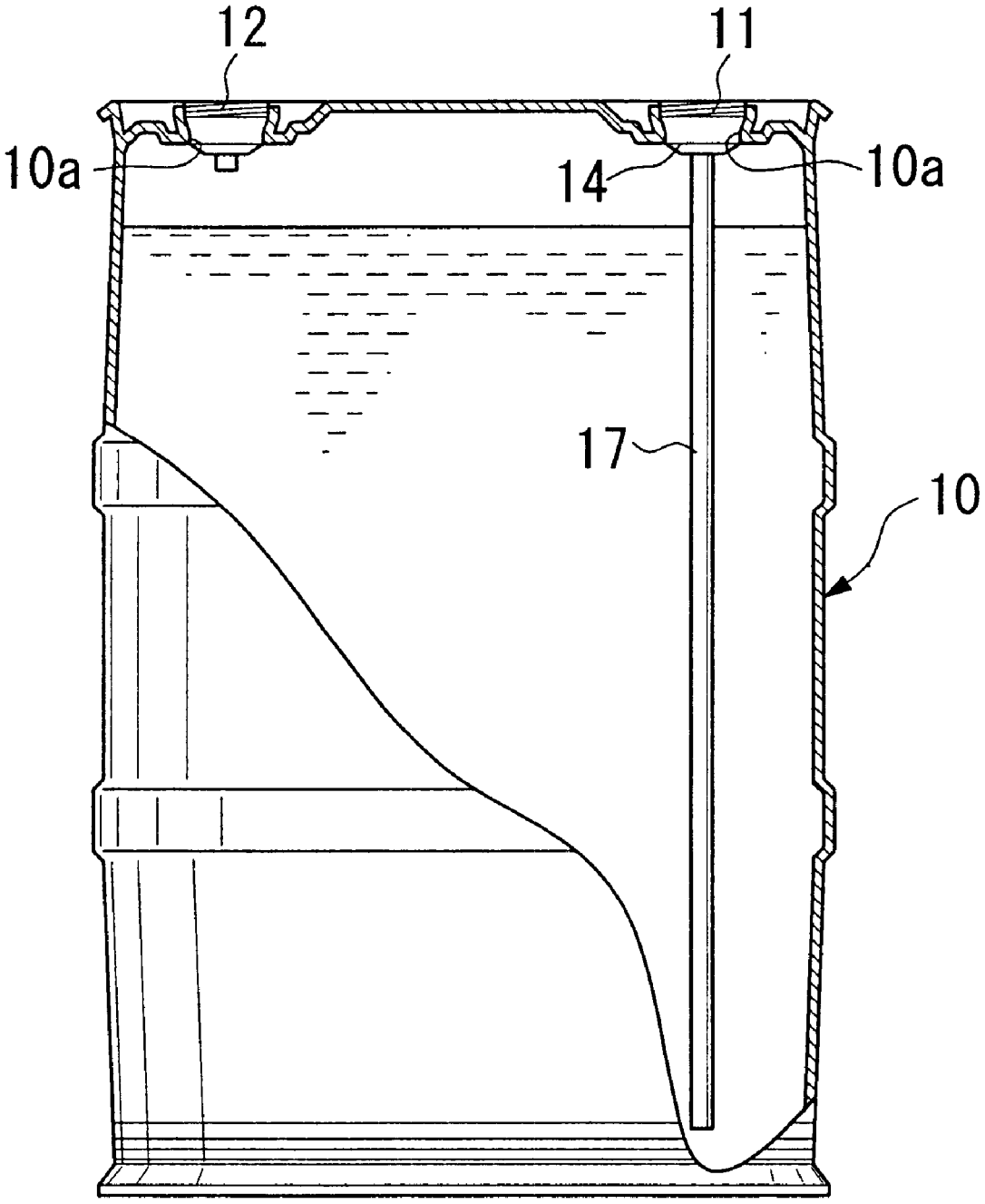
FIG. 1 is a cross section of the container for explaining the container according to the first embodiment of present invention.

In FIG. 1, the reference numeral 10 is the container. In this container 10, two openings 10*a* are formed, and a liquid path plug 11 and a gas path plug 12 which are both uniformly formed from synthetic resin are fitted into these openings 10*a*. In addition, the liquid path plug 11 and the gas path plug 12 function as lids which respectively close the openings 10*a* of the container 10.

Figure 2:
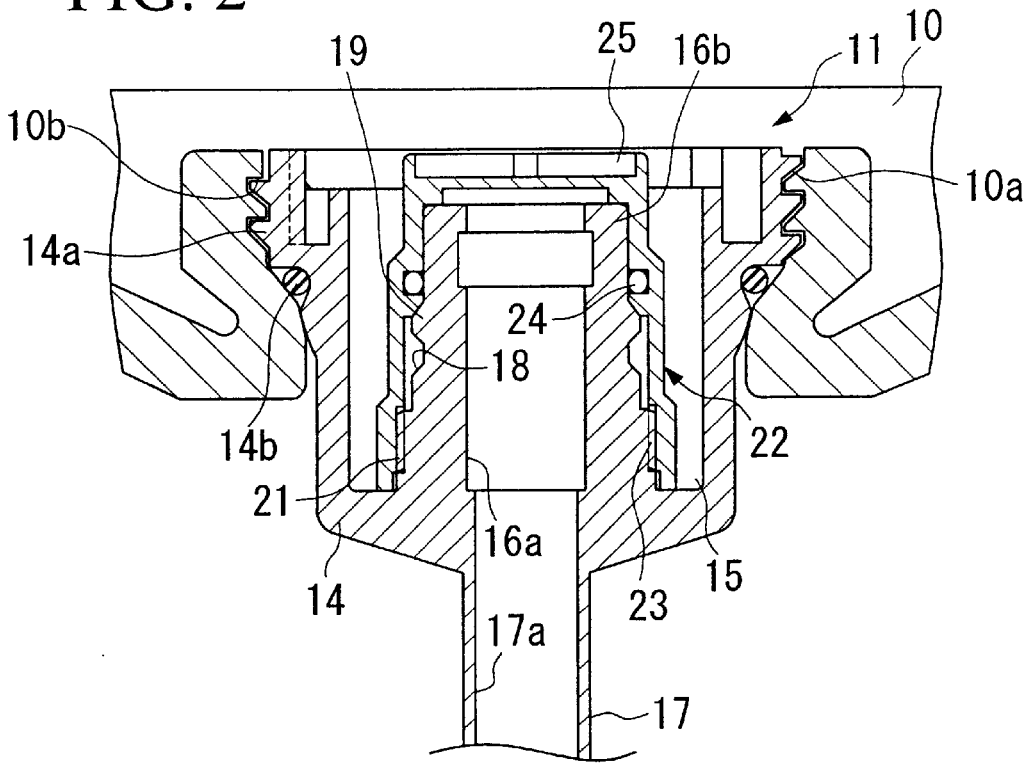
FIG. 2 is a cross section of the liquid path plug for explaining the organization and the construction of the liquid path plug used in the container according to the first embodiment of present invention.

Next, the liquid path plug 11 and the gas path plug 12 are respectively explained. As shown in FIG. 2, liquid path plug 11 has a lid section 14 which is attached by being screwed into opening 10*a* of the container 10, and a liquid path plug section 16*b* which is provided so as to protrude at the center of the concave section 15 formed on the lid section 14, and a pipe 17 which is formed in the lower part of the lid section 14.

The liquid path plug section 16*b* is formed as a cylinder having a through hole 16*a* in the center, and the liquid path plug section 16*b* is integrally formed with the lid section 14. In this liquid path plug section 16*b*, a stopping groove 18 which is formed in the shape of a ring extends in the circumferential direction is formed in the external surface of the liquid path plug section 16*b*, and when connecting the socket 5 to the liquid path plug section 16*b*, a locking ball 79 which will be explained later becomes engaged in the stopping groove 18. Also the top side of this stopping groove 18 is formed extending in the circumferential direction, the top side of this stopping groove 18 is made to be catching projection 19 which pushes the locking ball 79 and which will be explained later.

Also, the pipe 17 is formed as a long cylinder having a passage 17*a* in the center, the pipe 17 is integrally formed in the lower section of the lid section 14 in the same way as in the liquid path plug section 16*b*. Additionally, the passage 17*a* of this pipe 17 and the through hole 16*a* of the liquid path plug section 16*b* communicate with each other. The length of this pipe 17 is formed such that the bottom edge section of the pipe 17 is disposed near the bottom section of the container 10 when screwing and fixing the lid section 14 has been screwed into and fixed to the opening 10*a* of the container 10. Additionally, this pipe 17 can be formed separately from the lid section 14 and welded to the lid section 14.

The lid section 14 has, on the external surface of the top edge section of the lid section 14, a male thread section 14*a* which can be screwed into the female thread section 10*b* which is formed on the opening 10*a* of the container 10. By screwing this male thread section 14*a* into the female thread section 10*b* of the opening 10*a*, the lid section 14 is fixed to the opening 10*a* of the container 10. Additionally the O-ring 14*b* is provided in the lower side of the male thread section 14*a* on the lid section 14, when fixing the lid section 14 on the opening 10*a*, the gaps between these opening 10*a* and the lid section 14 is sealed by the O-ring 14*b*.

Also, a male thread 21 is formed on the external surface near the base of the liquid path plug section 16*b*, and a female thread 23 formed on the internal surface of the edge side of the opening of the liquid path cap 22 which is formed as a cylinder having a bottom section screws onto the male thread 21.

An O-ring 24 (sealing material) is provided on the internal surface of this liquid path cap 22. By covering the liquid path plug section 16*b* with this liquid path cap 22, and by screwing the female thread 23 onto the male thread 21 of the liquid path plug section 16*b*, this liquid path cap 22 is attached to the liquid path plug section 16*b*. The O-ring 24 provided on the internal surface sticks to the external surface of the liquid path plug section 16*b*, and the liquid path plug section 16*b* is perfectly sealed.

Figure 3:
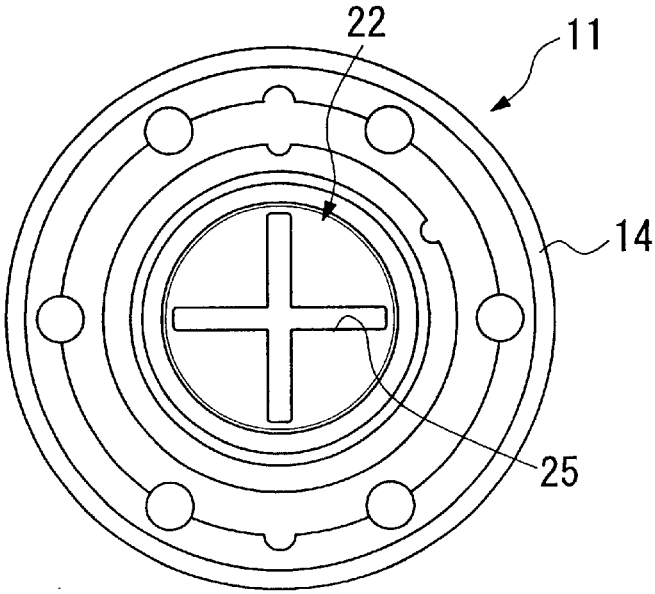
FIG. 3 is a plan view of the liquid path plug for explaining the shape of the liquid path cap which is put on the plug section of the liquid path plug used in the container according to the first embodiment of present invention.
Figure 4:
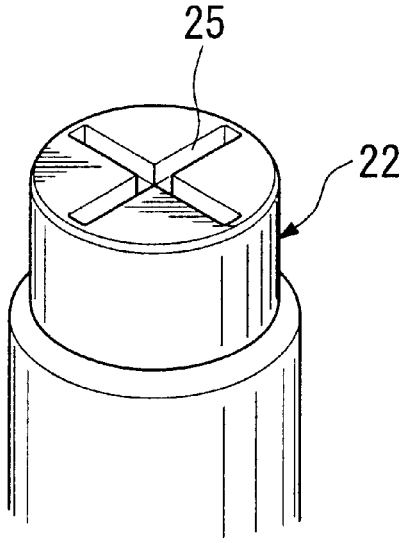
FIG. 4 is a perspective view of the liquid path cap for explaining the shape of the liquid path cap which is put on the plug section of the liquid path plug used in the container according to the first embodiment of present invention.

Also, as shown in FIGS. 3 and 4, the engaging groove sections 25 (engaging device) having the shape of a cross are formed on both edges of this liquid path cap 22.

Figure 5:
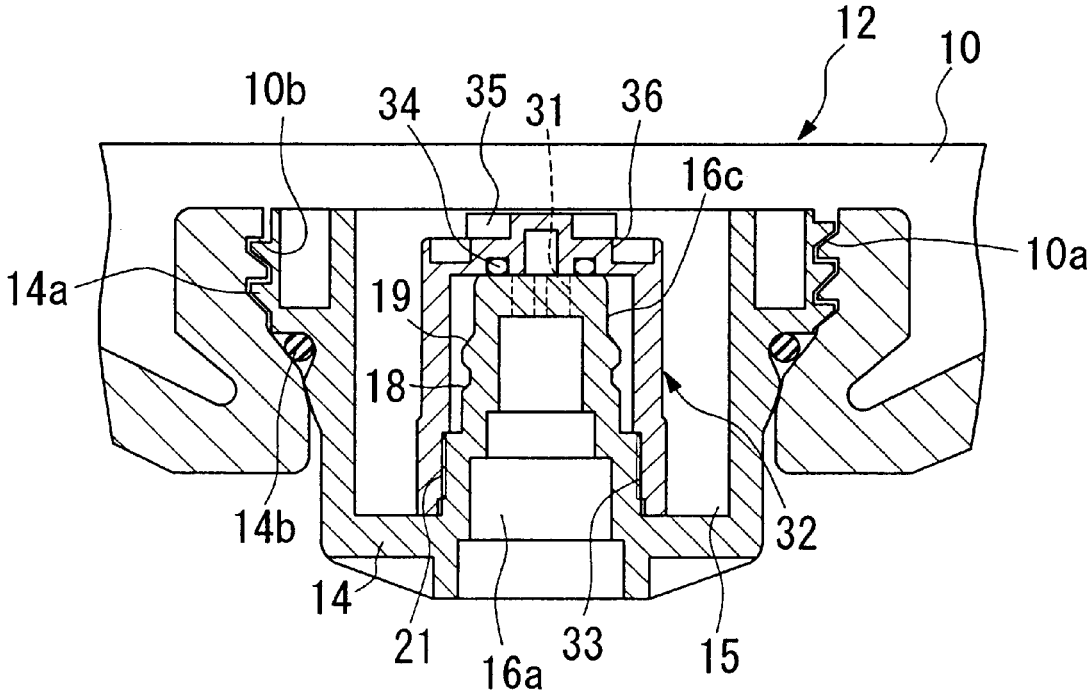
FIG. 5 is a cross section of the gas path plug for explaining the organization and the construction of the gas path plug used in the container according to the first embodiment of present invention.

As shown in FIG. 5, the gas path plug 12 is constructed in almost the same way as the liquid path plug 11 which is explained above, and structures similar to those of the liquid path plug 11 are indicated with the same reference numerals and explanation for them will be emitted.

The pipe 17 is not formed in this gas path plug 12. Furthermore, a plurality of hole sections 31 are formed in the edge section of the plug section 16.

Additionally, the male thread 21 is formed in the external surface near the base of the gas path plug section 16*c* of this gas path plug 12, and a female thread 33 formed on the inside surface of the opening edge section side of the gas path cap 32 formed as a cylinder having a bottom section is screwed into this male thread 21.

The O-ring 34 is provided on the bottom surface of this gas path cap 32, by covering the gas path plug section 16*c* with the gas path cap 32, and by screwing the female thread 33 onto the male thread 21 of the gas path plug section 16*c*, this gas path cap 32 is attached to the gas path plug section 16*c*, the O-ring 34 formed on the bottom surface makes contact with the end surface of the gas path plug section 16*c*, and the gas path plug section 16*c* is perfectly sealed.

Figure 6:
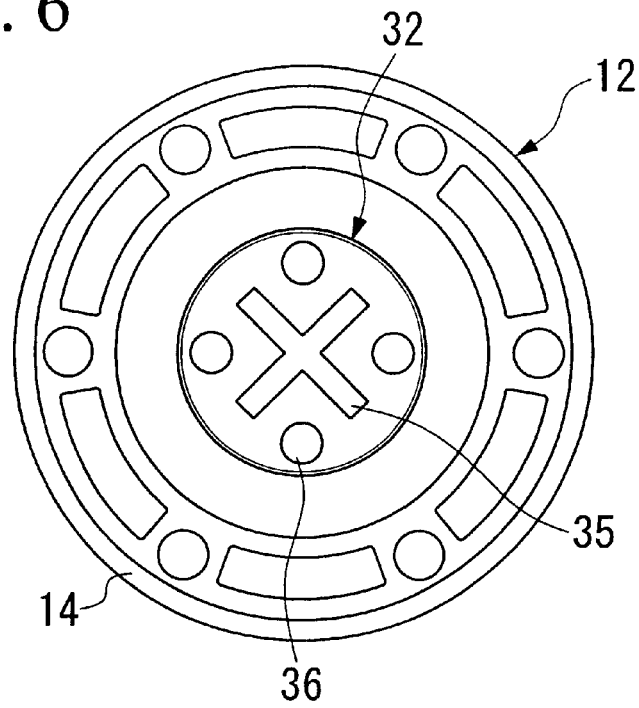
FIG. 6 is a plan view of the gas path plug for explaining the shape of the gas path cap which is put on the plug section of the gas path plug used in the container according to the first embodiment of present invention.
Figure 7:
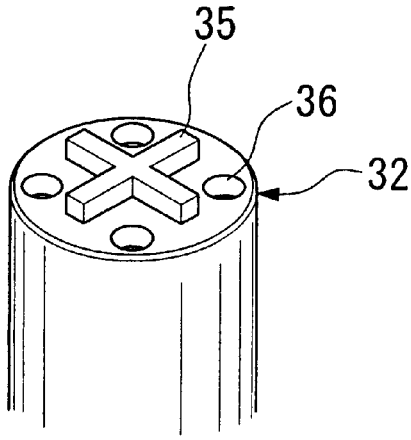
FIG. 7 is a perspective view of the gas path cap for explaining the shape of the gas path cap which is used on the plug section of the gas path plug used in the container according to the first embodiment of present invention.

Also, as shown in FIGS. 6 and 7, an engaging protrusion section (engaging device) 35 in the shape of a cross is formed in the end surface of this gas path cap 32, and a plurality of engaging hole sections 36 (engaging device) are formed leaving an interval in the circumferential direction.

Consequently, in order to take out the liquid stored in above container 10 in which the liquid path plug 11 and the gas path plug 12 have been attached to the opening 10*a* of the container 10, the gas path cap 32 attached to the gas path plug section 16*c* of the gas path plug 12 is detached, the hole section 31 of the gas path plug section 16*c* of the gas path plug 12 is opened, and the difference in the pressure between the inside and the outside of the container 10 is nullified. After that, the liquid path cap 22 attached to the liquid path plug section 16*b* of the liquid path plug 11 is detached, the socket 5 to which a hose 4 is connected is connected to the respective plug section 16.

Next, for a container 10 of above construction, a detailed explanation will be made for the case of drawing out the liquid inside the container 10 by connecting sockets 5, to which the hoses 4 are connected, respectively to the liquid path plug section 16*b* of the liquid path plug 11 and the gas path plug 12 which are attached to the openings 10*a*.

The Detaching of the Gas Path Cap

Figure 8:
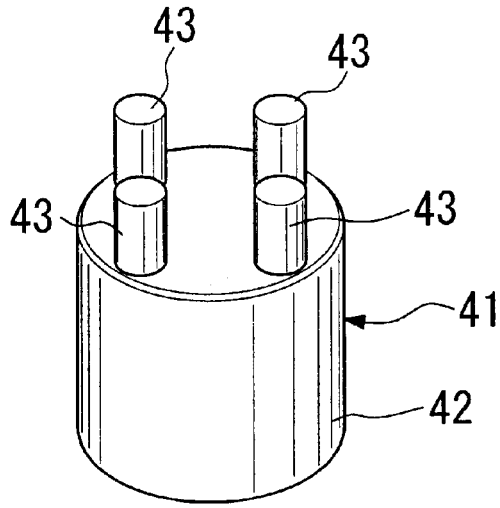
FIG. 8 is a perspective view of the detaching fixture for explaining the detaching fixture which detaches the gas path cap which has been put on the plug section of the gas path plug used in the container according to the first embodiment of present invention.
Figure 9:
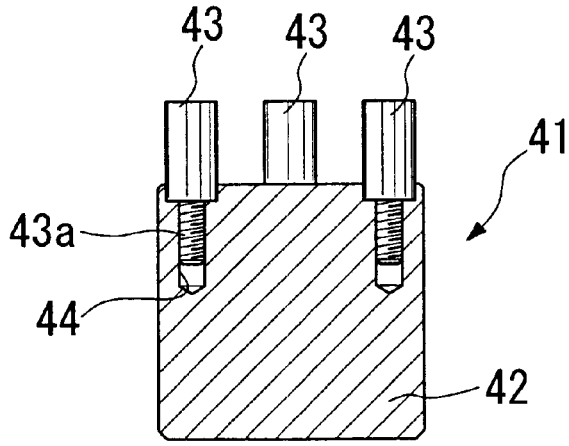
FIG. 9 is a cross section of the detaching fixture for explaining the detaching fixture which detaches the gas path cap which has been put on the plug section of the gas path plug used in the container according to the first aspect of present invention.

First, the gas path cap 32 attached to the gas path plug section 16*c* of the gas path plug 12 is detached. In order to detach this gas path cap 32, the detaching fixture 41 is used as shown in FIGS. 8 and 9.

This detaching fixture 41 comprises a fixture body 42 which is formed in a pillar shape and a plurality of engaging pins 43 provided in the end surface of this fixture body 42, and the side peripheral surface of the fixture body 42 is formed in a fine saw-tooth shape, in other words a Knurled shape.

On this fixture body 42, four thread holes 44 are formed on the end surface at an interval in the circular direction, and a thread section 43*a* formed on the engaging pin 43 is screwed into this thread hole 44, and is fixed to this thread hole 44.

Figure 10:
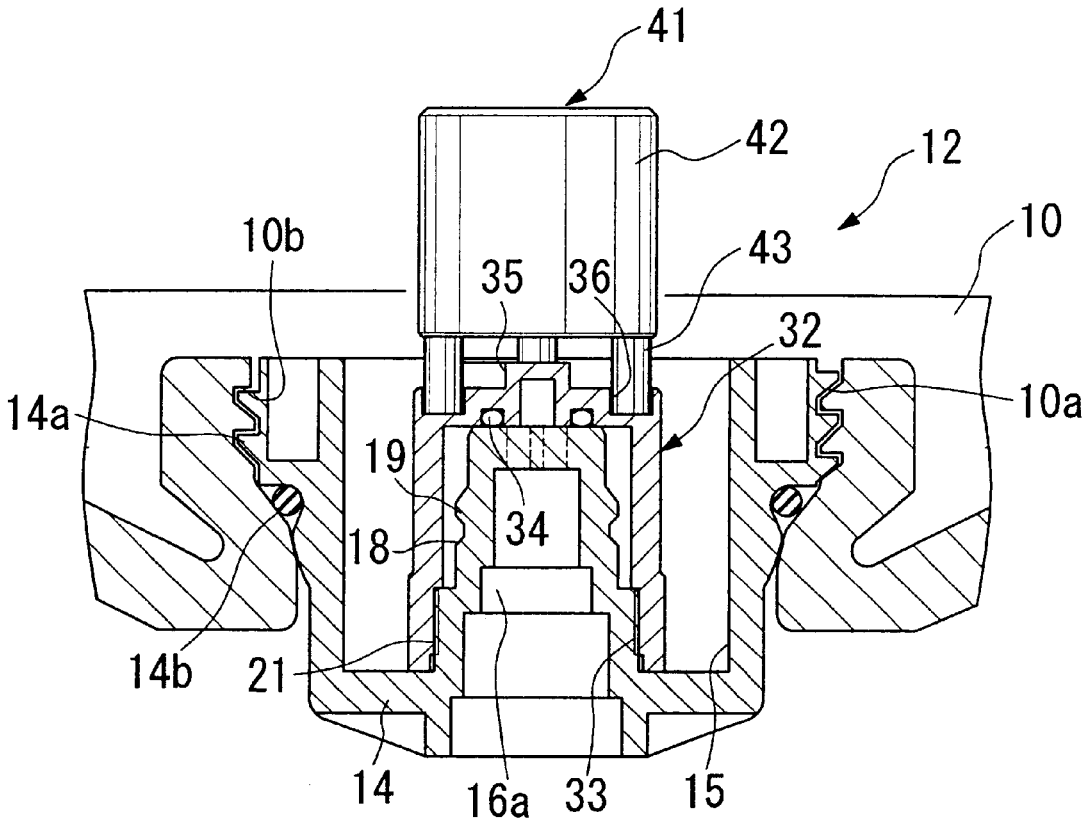
FIG. 10 is a cross section of the gas path plug for explaining the detaching method of the gas path cap which has been put on the plug section of the gas path plug of the container according to the first aspect of present invention.

Consequently, in order to detach the gas path cap 32 using this detaching fixture 41, in the state that the fixture body 42 of this detaching fixture 41 is clamped, as shown in FIG. 10, the engaging pin 43 fits into the engaging hole section 36 formed on the end surface of the gas path cap 32, and the engaging pin 43 is turned in the direction of unscrewing.

By doing it in this way, the gas path cap 32 which has been screwed into the male thread 21 of the gas path plug section 16*c* is unscrewed and then the gas path cap 32 is detached.

Consequently, when this gas path cap 32 is unscrewed and detached, the inside of the container 10 communicates with the outside of the container by way of the through hole 16*a* of the gas path plug section 16*c* of the gas path plug 12.

By this step, even if the internal pressure increases due to the vaporization of the liquid inside the container 10, by detaching the gas path cap 32, gas inside the container 10 flows to the outside of the container 10, and the difference in the pressure between the inside and the outside of the container 10 is nullified.

The Detaching of the Liquid Path Cap

Next, the liquid path cap 22 attached to the liquid path plug section 16*b* of the liquid path plug 11 is detached.

Figure 11:
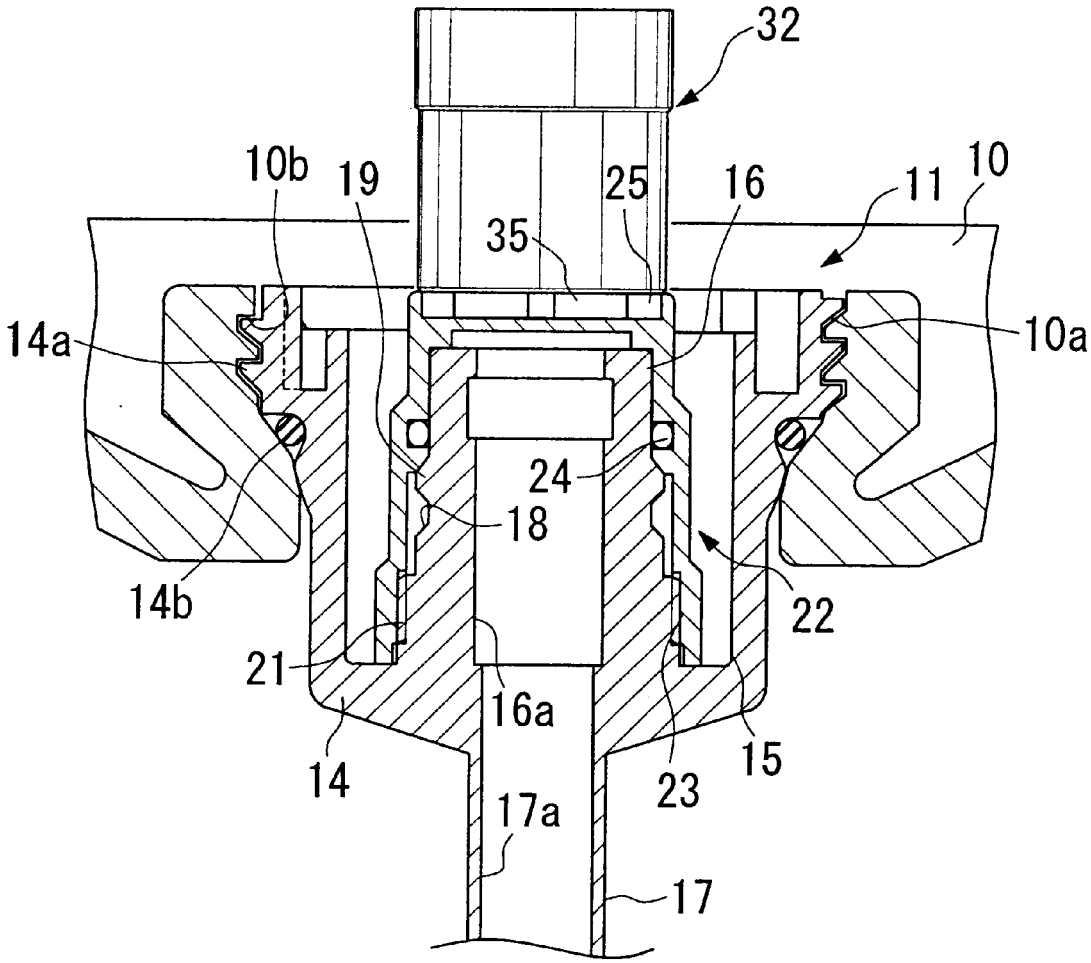
FIG. 11 is a cross section of the liquid path plug for explaining the detaching method of the liquid path cap which is put on the plug section of the liquid path plug of the container according to the first embodiment of present invention.

In order to detach this liquid path cap 22, the gas path cap 32 which has already been detached is used. More specifically, in the state that this gas path cap 32 is clamped, as shown in FIG. 11, the engaging protrusion section 35 formed in the end surface of the gas path cap 32 is fitted to the engaging groove section 25 formed in the end surface of the liquid path cap 22, and is turned to the direction of unscrewing.

By doing it in this way, the liquid path cap 22 which was screwed into the male thread 21 of the liquid path plug section 16*b* is unscrewed and detached. At this time, any pressure difference between the inside of the container 10 and the outside is eliminated because the gas path cap 32 of the gas path plug 12 has already been detached, and the liquid from inside the container 10 does not pass through the pipe 17 and leak from the through hole 16*a* of the liquid path plug section 16*b*.

By performing the above steps, it is possible quite safely to detach the gas path cap 32 and the liquid path cap 22 from the gas path plug 12 and the liquid path plug 11, connect the socket 5 to which the hose 4 is connected, and take out the liquid inside the container 10.

Here, the connected construction of the plug sections 16*b*, and 16*c*, and the socket 5 will be explained by taking an example of the liquid path plug 11.

Figure 12:
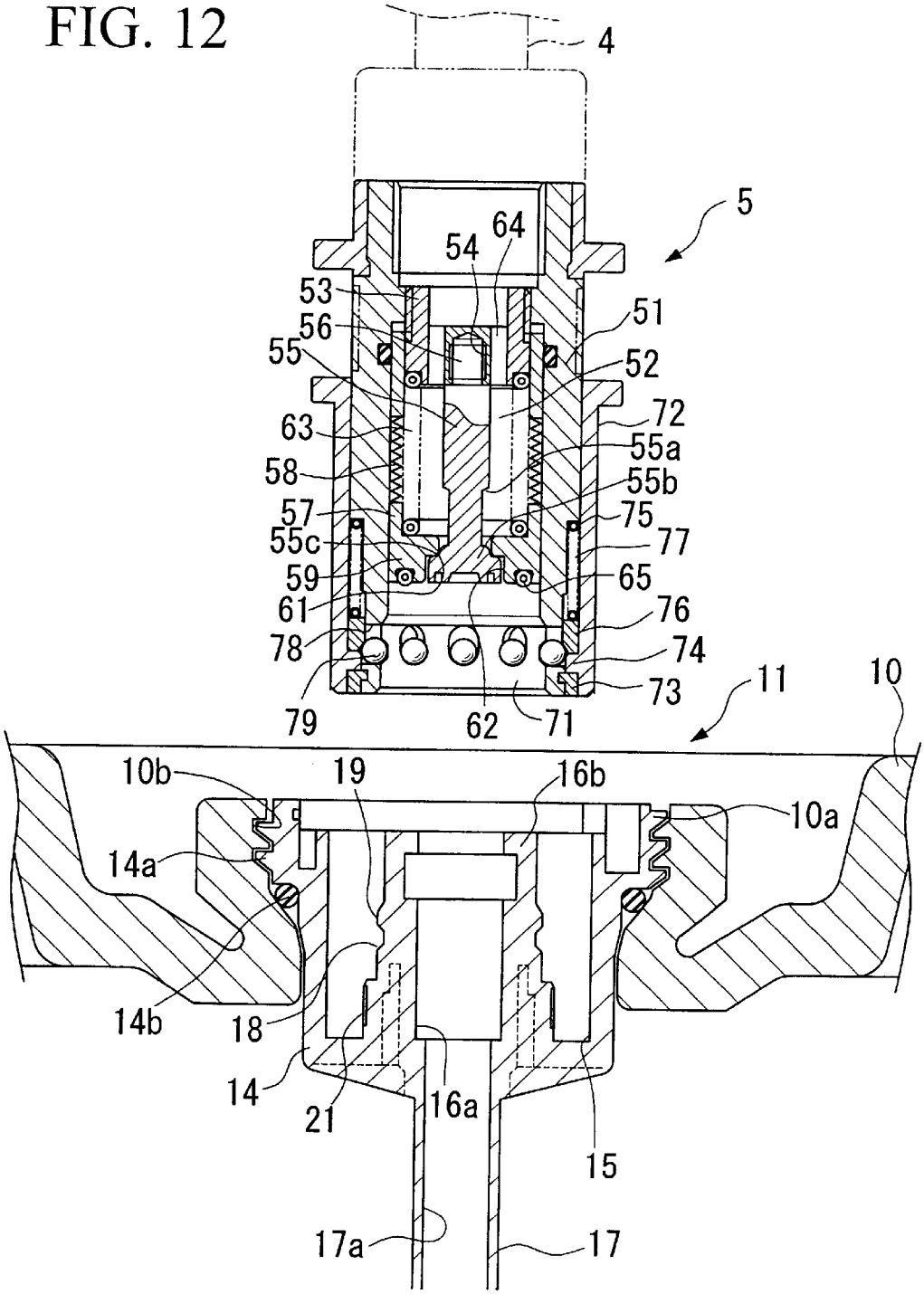
FIG. 12 is a cross section of the plug section and the socket explaining the construction of the socket which is connected to the plug section of the liquid path plug of the container according to the first embodiment of present invention.

As shown in FIG. 12, the socket 5 has a main cylinder body 51 inside of which a valve hole 52 is formed. In the valve hole 52 of this main cylinder body 51, a stopper 53 is fixed at the rear end section. In this stopper 53, a male thread section 56 of the end section of the valve member 55 formed in a bar shape is screwed and fixed into the female thread section 54 formed in the center of the stopper.

A narrow part 55*a* is formed near the end of this valve member 55, and a valve 55*b* having a large diameter is formed closer to the end of this valve member 55 than this narrow part 55*a*.

Also, a step section 55*c* is formed on the narrow section 55*a* side in this valve 55*b*.

Also, a bellows member 57 is provided in the valve hole 52. This bellows member 57 is formed as a cylinder having a bellows member 58 formed such that it has a cross section at the center section, and the bellows member 57 can extend and shrink in the axis direction at the bellows member 58. Additionally, the rear end section of this bellows member 57 is clamped and fixed between the external surface of the stopper 53 and the internal surface of the main cylinder body 51. Also, a valve boss section 59 is formed on the top side of this bellows member 57. This valve boss section 59 has a hole section 61 in the center, the top side of this hole section 61 is formed with a larger diameter, and this section is made to be a step section 62.

Also, a spring 63 is provided between the stopper 53 and the valve boss section 59 of the bellows member 57, the valve boss section 59 of the bellows member 57 is always pushed towards the top side by this spring 63, by this pushing force, the valve 55*b* of the valve member 55 is fitted in the hole section 61 of the valve boss section 59, and the gap between the valve 55*b* and the valve boss section 59 is closed.

Also, a plurality of paths 64 are formed in the circular direction on the stopper 53, and the hose 4 side and the inside of the bellows member 57 communicates by these paths 64.

Additionally, O-ring 65 is provided over the circular direction in the top surface of the valve boss section 59.

Also, a concave section 71 is formed on the top side of the main cylinder body 51, it is provided such that the plug section 16*b* is fitted into this concave section 71. Also, a sleeve 72 is provided which is able to slide on the external surface of the main cylinder body 51. Detachment of the sleeve 72 from the top section of the main cylinder body 51 is prevented by the stop ring 73 formed on the top section of the main cylinder body 51. A prong part 74 is provided in the internal surface side near the end section of this sleeve 72, a push ring 76 and a spring 77 are provided between this prong part 74 and a step section 75 formed on the external surface of the main cylinder body 51. Consequently, the sleeve 72 is always pushed towards the direction of the end section of the main cylinder body 51 by this spring 77.

Also, the hole section 78 is a long hole in a mortar shape and is formed with an interval towards the circular direction near the end section of the main cylinder body 51, and the lock ball 79 is provided in this hole section 78.

Consequently, in the state that the sleeve 72 is moved in the direction of the rear end section of the main cylinder body 51, the lock ball 79 is made to be able to move into and appear out of the internal surface side of the concave section 71 of the main cylinder body 51, when moving the sleeve 72 to the top section side by the pushing force of the spring 77, the lock ball 79 is pushed into the internal surface side by the prong part 74 of the sleeve 72, and is maintained such that a part of the lock ball 79 projects from the concave section 71.

Figure 13:
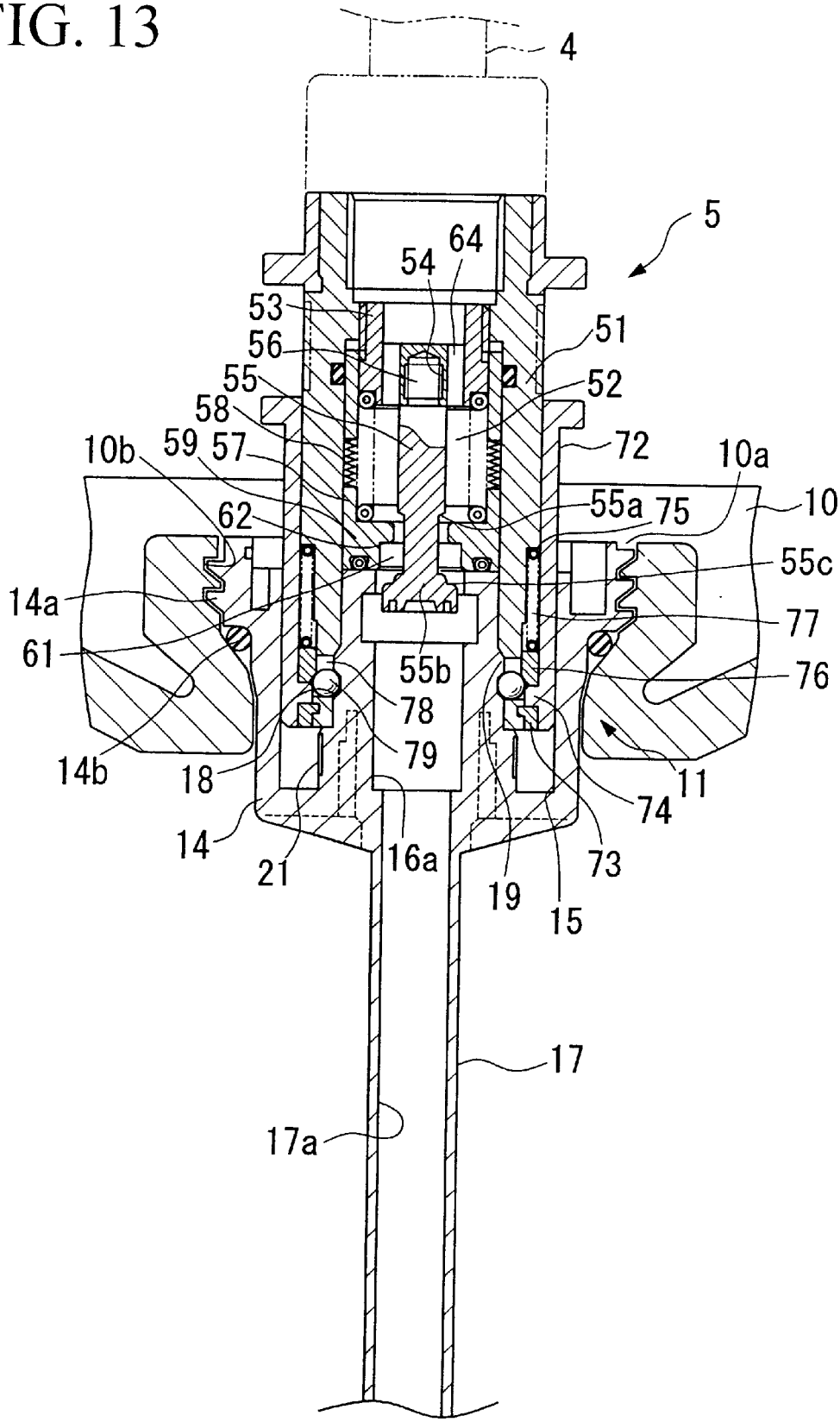
FIG. 13 is a cross section of the plug section and socket, both of which are connected to each other, for explaining the connecting construction of the plug section of the liquid path plug and the socket of the container according to the first embodiment of present invention.

Consequently, by pushing the socket 5 of above construction into the liquid path plug section 16*b*, as shown in FIG. 13, the socket 5 can be connected to the plug section 16 by hand with a single operation.

Here, this connection method is explained.

When the socket 5 is pushed into the liquid path plug section 16*b*, firstly the lock ball 79 of the socket 5 makes contact with the catching projection 19 of the plug section 16. If the socket 5 is pushed further, the lock ball 79 projects to the external circumference side due to the catching projection 19. Thereby, the push ring 76 provided in the external circumference side of the lock ball 79 resists the pushing force of the spring 77 and is moved to the rear end side of the socket 5. Thereby, the lock ball 79 enters the gap made between the push ring 76 and the prong part 74 of the sleeve 72.

When the socket 5 is pushed into the liquid path plug section 16*b* further and the lock ball 79 overreaches the catching projection 19, the lock ball 79 which is pushed towards the internal surface side of the concave section 71 by the spring 77 by way of the push ring 76 projects to the internal surface side of the concave section 71 and enters into the stopping groove 18, also the push ring 76 is moved to the top edge side of the socket 5 and makes contact with the prong part 74, and the gap is closed.

In this condition, the state becomes such that the socket 5 is connected to the liquid path plug section 16*b*, even if a pulling force is applied to the socket 5 from the liquid path plug section 16*b*, the movement of the lock ball 79 to the external surface side is regulated by the prong part 74 of the sleeve 72, thereby, secure locking between these socket 5 and the liquid path plug section 16*b* is achieved.

Additionally, in this way, when the socket 5 is connected to the liquid path plug section 16*b*, the valve boss section 59 of the bellows member 57 of the socket 5 contacts the top end section of the liquid path plug section 16*b*, thereby, this valve boss section 59 resists the pushing force of the spring 63 and is pushed to the rear edge side of the socket 5, the bellows member 58 contracts, and the state becomes such that the valve 55*b* of the valve member 55 of the socket 5 is inserted in the through hole 16*a* of the liquid path plug section 16*b*.

As a result, the valve boss section 59 of the bellows member 57 and the valve 55*b* of the valve member 55 separate, a path is formed between them, and the hose 4 connected to the socket 5 and the passage 17*a* of the pipe 17 communicate.

Additionally, the socket 5 to which the hose 4 which supplies the inert gas into the container 10 is connected is combined with the gas path plug section 16*c* of the gas path plug 12.

Additionally, by doing the above, and by operating the pump P after connecting the sockets 5 to the plug sections 16*b* and 16*c* of the liquid path plug 11 and the gas path plug 12, the liquid inside the container 10 is sucked from the lower end section of the pipe 17, passes through the liquid path plug 11 and the socket 5, and then is fed into the hose 4.

Additionally, at this time, the inert gas is fed from the hose 4 of the socket 5 connected with the gas path plug 12 of the opening 10*a* on the other side, and stored in the container 10*a*, and the pressure inside the container 10 does not become negative.

Additionally, when detaching the sockets 5 from the plug sections 16*b* and 16*c*, the sleeves 72 of the sockets 5 are pulled to the rear edge section side. By doing it in this way, the prong part 74 of the sleeve 72 is moved towards the rear end section of the socket 5 raising the push ring 76, and as a result, a gap is formed between this prong part 74 and the stop ring 73 at the top end section side of the prong part 74.

Consequently, when the socket 5 is extracted from the plug section 16*b* and 16*c* in this state, the lock ball 79 is moved towards the external circumference side by entering the gap between the prong part 74 and the stop ring 73 by the catching projection 19, and it is possible to extract the socket 5 from the plug section 16*b*, 16*c*.

Additionally, when the sockets 5 are extracted form the plug sections 16*b* and 16*c* in the state that the sleeves 72 are pulled to the rear edge section side and the locks are released in this way, the valve boss sections 59 of the bellows member 57 of the socket 5 are pushed to the top end section side by the spring 63, thereby, the valve 55*b* of the valve member 55 is fitted into the hole section 61 of this valve boss section 59, and the path which was formed between the valve boss section 59 and the valve 55*b* is blocked.

More specifically, by extracting the socket 5 from the plug section 16 by pulling the sleeve 72 of the socket 5 towards the rear end section side, it is possible to detach the sockets 5 from the plug sections 16*b* and 16*c* and release the connection quite easily.

As explained above, with the container 10 of the above first embodiment, when detaching the liquid path cap 22 and the gas path cap 32 blocking the through holes 16*a* and 16*a* of the respective plug sections 16*b* and 16*c* of the liquid path plug 11 and the gas path plug 12 attached to the openings 10*a* and 10*a*, and when drawing out the liquid inside the container 10, the liquid path cap 22 is made to be detachable with the gas path cap 32 detached from the gas path plug section 16*c* of the gas path plug 12. Therefore, when detaching each cap 22 and 23 in order to take out the liquid inside the container 10, the detaching of the liquid path cap 22 is always carried out after the detaching of the gas path cap 32. As a result, even if the internal pressure increases due to the vaporization of the liquid inside the container 10, because the gas path cap 32 of the gas path plug 12 has already been detached and the difference in the pressure between the inside and the outside of the container 10 is nullified when detaching the liquid path cap 22, problems such that the liquid inside the container 10 passes through the pipe 17 and leaks from the through hole 16*a* of the liquid path plug section 16*b* can be securely eliminated.

More specifically, by performing such detaching steps, it is possible to detach the gas path cap 32 and the liquid path cap 22 from the gas path plug 12 and the liquid path plug 11, connect the socket 5 connected with the hose 4, and take out the liquid inside the container 10 quite safely.

Also, when detaching the gas path cap 32 attached to the gas path plug section 16*c* of the gas path plug 12, because the detaching fixture 41 is used, it is possible to securely manage not only to open and close the liquid path cap 22 but also to open and close the gas path cap 32, and it is possible to improve safety further.

In addition, by covering and attaching respectively the liquid path cap 22 and the gas path cap 32 formed as the cylinders having a bottom section to the plug sections 16*b* and 16*c* formed as cylinders, it is possible to securely and easily seal the through hole 16*a* of the plug sections 16*b* and 16*c* of the container 10 when carrying and storing.

Also, turning respectively the liquid path cap 22 and the gas path cap 32 with respect to the plug sections 16*b* and 16*c*, it is possible to attach and to detach the liquid path cap 22 and the gas path cap 32 to and from the plug section 16*b* and 16*c* quite easily.

In addition, by attaching and turning the engaging pin 43 of the detaching fixture 41 at the engaging hole section 36 of the gas path cap 32, it is possible to unscrew and detach the gas path cap 32 using the detaching fixture 41 quite easily, and, by fitting the engaging protrusion section 35 of the gas path cap 32 on the engaging groove section 25 of the liquid path cap 22 and turning the engaging protrusion section 35, it is possible to unscrew and detach the liquid path cap 22 by the gas path cap 32 quite easily.

More specifically, because the gaps between the detaching fixture 41 and the gas path cap 32, and between the gas path cap 32 and the liquid path cap 22 are constructed to engage each other by convexo-concave interfitting, it is possible to carry out the detaching operation of the liquid path cap 22 and the gas path cap 32 easily.

Second Embodiment

Next, the second embodiment is explained.

Additionally, the section of the same construction as the above first embodiment is added the same reference numerals, and the explanation is omitted.

Figure 14:
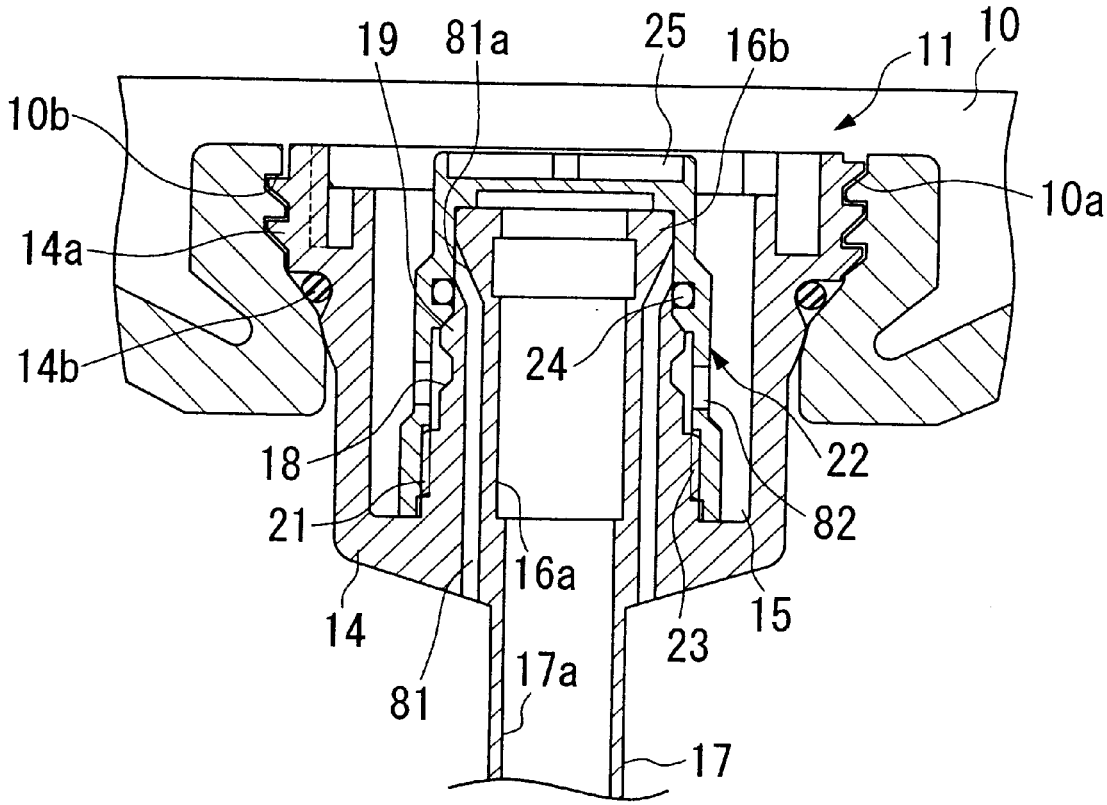
FIG. 14 is a cross section of the liquid path plug for explaining the organization and the construction of the liquid path plug according to the second aspect of present invention.
Figure 15:
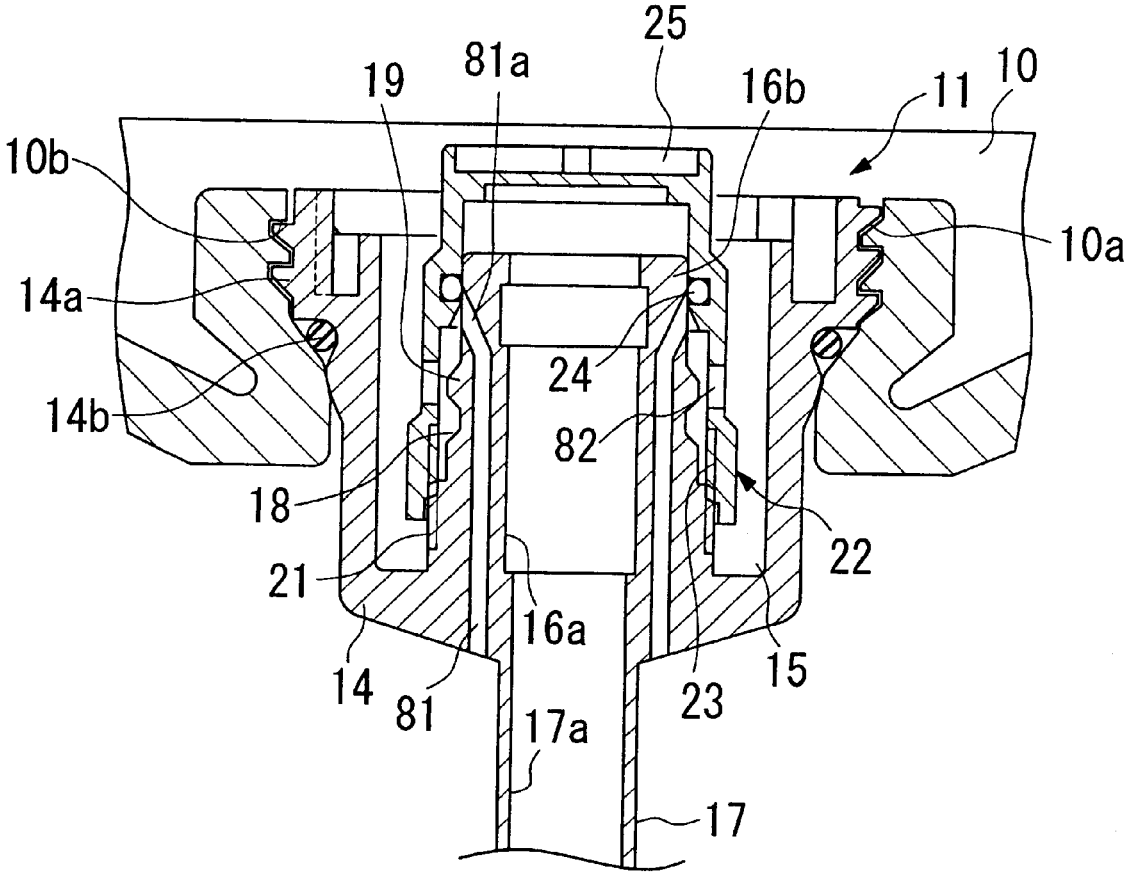
FIG. 15 is a cross section of the liquid path plug for explaining the function of the liquid path plug according to the second aspect of present invention.
Figure 16:
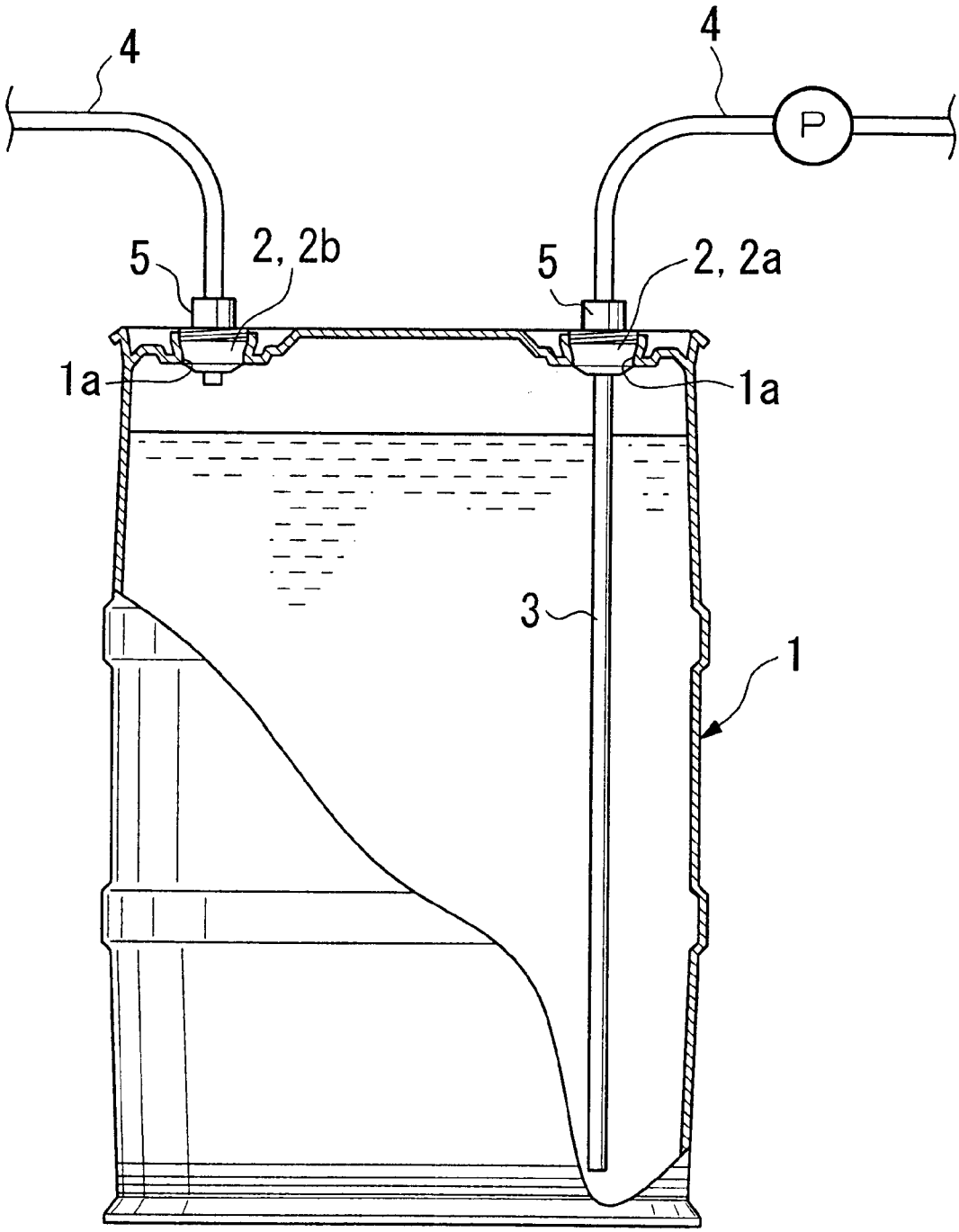
FIG. 16 is a cross section of the container for explaining the method of drawing out the liquid from the container in which the liquid is stored.

As shown in FIG. 14, in this embodiment, a plurality of gas removal paths 81 connect through with the surrounding surface near the upper end of the liquid path plug section 16*b* and the bottom surface of the lid section 14 are formed on the liquid path plug 11 for connection with the liquid path with an interval towards the circumference direction.

Also, a plurality of gas removal holes 82 are formed between the female thread 23 and the O-ring 24 on the liquid path cap (cap) 22 attached to the liquid path plug section 16*b* of this liquid path plug 11.

Additionally, the opening 81*a* on the surrounding surface of the liquid path plug section 16*b* of the gas removal path 81 formed on the liquid path plug section 16*b* is formed at a position which disposes the opening 81*a* at a lower side of the liquid path cap 22 than the O-ring 24 in the state that the liquid path cap 22 is attached to this liquid path plug section 16*b*.

Consequently, according to above construction, when unscrewing this liquid path cap 22 in order to detach the liquid path cap 22 attached to the liquid path plug section 16*b*, when the O-ring 24 of the liquid path cap 22 goes past the opening 81*a* of the gas removal path 81 and moves to the upper edge side of the liquid path plug section 16*b*, the inside and the outside of the container 10 communicate by way of the gas removal path 81 of the liquid path plug section 16*b* and the gas removal hole 82 of the liquid path cap 22.

As a result, even if the internal pressure increases due to the vaporization of the liquid inside the container 10, the gas inside the container 10 flows out to the outside of the container by way of the gas removal path 81 and the gas removal hole 82, and the difference in the pressure between the inside and the outside of the container 10 is eliminated.

Accordingly, even if this liquid path cap 22 is further unscrewed and detached completely, because the difference in the pressure between the inside and the outside of the container 10 is already nullified, the liquid inside the container 10 does not passes through the pipe 17 and leaks from the through hole 16*a* of the plug section 16.

In this way, by means of the liquid path plug 11, when unscrewing and detaching the liquid path cap 22 which has been screwed and attached to the plug section 16, the O-ring 24 provided in the internal surface of the liquid path cap 22 moves farther towards the top end section side of the plug section 16 than the opening 81*a* of the gas removal path 81, and because the gas removal path 81 is opened before the through hole 16*a* is opened, even if the internal pressure of the container 10 increases, the difference in the pressure between the inside and the outside of the container 10 is nullified, and problems such that the liquid passes through the pipe 17 and leaks from the through hole 16*a* can be securely prevented.

Also, by covering the plug section 16 with the liquid path cap 22 and by screwing the liquid path cap 22, it is possible quite easily to attach the liquid path cap 22 to the plug section 16, block the through hole 16*a* and the gas removal path 81, and carry and store the container 10 well.

Additionally, the construction of the liquid path cap 22 of the above second embodiment can be used in combination with the container 10 of the first embodiment.

Consequently, by combining in this way, even if the internal pressure of the container 10 increases when detaching the liquid path cap 22, because the opening of the gas removal path 81 formed on the liquid path plug section 16*b* is opened and the inside of the container 10 communicates with the outside of the container before the through hole 16*a* of the liquid path plug section 16*b* is opened when detaching the liquid path cap 22, problems such that the liquid passes through the pipe 17 and leaks from the through hole 16*a* can be more securely prevented.

Accordingly, even if an operator tries to detach the liquid path cap 22 of the plug section 16 of the liquid path plug 11 of another container 10 using the gas path cap 32 detached from the liquid path plug section 16*b* of the gas path plug 12 of the container 10, it is possible to prevent securely the leakage of liquid from the through hole 16*a* of the liquid path plug section 16*b* due to the internal pressure of the container 10.

What is claimed is:

1. A container comprising:

a container body; and at least one liquid path plug and at least one gas path plug which are attached to openings formed in the container body;

wherein the liquid path plug has a lid section attached to the opening in a watertight manner, a liquid path plug section having a through hole communicating with an inner space of the container body, a pipe which is connected to the liquid path plug section and which is accommodated in the container body, and a liquid path cap which is detachably attached to the liquid path plug section to block the through hole;

the gas path plug has a lid section attached to the opening in a watertight manner, and a gas path plug section having a through hole communicating with the inner space of the container body, and a gas path cap which is detachably attached to the gas path plug section to block the through hole; and the gas path cap has a disengaging section which can be used to detach the liquid path cap from the liquid path plug section.

2. A container according to claim 1, wherein the gas path cap is detachable by a detaching fixture.

3. A container according to claim 1, wherein the liquid path plug section and the gas path plug section are formed in a cylindrical shape in which the through hole is formed in the center, and the liquid path cap and the gas path cap are attached to cover the plug sections, and the liquid path cap and the gas path cap are formed in cylindrical shapes having bottom sections in order to block the through hole.

4. A container according to claim 3, wherein male threads are formed on external surfaces of the liquid and gas path plug sections, a female thread into which can be screwed on the male thread of the plug section is formed on the internal surface of the liquid path cap and the gas path cap, and the liquid path cap and the gas path cap are attached to the plug section by screwing the female thread on the male threads.

5. A container according to claim 4, wherein the detaching fixture can detach the gas path cap from the gas path plug section, and a disengaging section of the gas path cap can detach the liquid path cap from the liquid path plug section.

6. A container according to claim 5, wherein an engaging pin which can fit to an engaging hole section formed on the end surface of the gas path cap in concavo-convex manner is provided in the detaching fixture, the engaging hole section which can fit into an engaging groove section formed on the end surface of the liquid path cap in concavo-convex manner is formed on the gas path cap, the engaging device is formed respectively by the engaging hole section and the engaging pin, and by the engaging groove section and the engaging protrusion section.

7. A container according to claim 3 wherein a gas removal path is formed in the liquid path plug section of the liquid path plug, the gas removal path connects the external surface and the bottom surface of the lid section, and the gas removal path is blocked by the liquid path cap which is attached, and the gas removal path is opened before the through hole is opened when detaching the liquid path cap.

8. A container according to claim 4 wherein a gas removal path is formed in the liquid path plug section of the liquid path plug, the gas removal path connects the external surface and the bottom surface of the lid section, and the gas removal path is blocked by the liquid path cap which is attached, and the gas removal path is opened before the through hole is opened when detaching the liquid path cap.

9. A container according to claim 5 wherein a gas removal path is formed in the liquid path plug section of the liquid path plug, the gas removal path connects the external surface and the bottom surface of the lid section, and the gas removal path is blocked by the liquid path cap which is attached, and the gas removal path is opened before the through hole is opened when detaching the liquid path cap.

10. A container according to claim 6 wherein a gas removal path is formed in the liquid path plug section of the liquid path plug, the gas removal path connects the external surface and the bottom surface of the lid section, and the gas removal path is blocked by the liquid path cap which is attached, and the gas removal path is opened before the through hole is opened when detaching the liquid path cap.

* * * * *